US007156583B2

(12) United States Patent
Masetti et al.

(10) Patent No.: US 7,156,583 B2
(45) Date of Patent: Jan. 2, 2007

(54) COMPENSATING SUSPENSION ELEMENT CONFIGURATION

(75) Inventors: Isaias Quaresma Masetti, Rio de Janeiro (BR); Ana Paula Dos Santos Costa, Rio de Janeiro (BR); Luis Claudio Sousa Costa, Rio de Janeiro (BR); Julio Eduardo Dutra Ribeiro, Macae (BR)

(73) Assignee: Petroleo Brasileiro S.A, Petrobras (BR)

( * ) Notice: Subject to any disclaimer, the term of this patent is extended or adjusted under 35 U.S.C. 154(b) by 0 days.

(21) Appl. No.: 11/035,891

(22) Filed: Jan. 18, 2005

(65) Prior Publication Data

US 2005/0196242 A1 Sep. 8, 2005

(30) Foreign Application Priority Data

Mar. 2, 2004 (BR) ..... PI 0400422

(51) Int. Cl.
*F16L 1/18* (2006.01)
*F16L 1/23* (2006.01)

(52) U.S. Cl. ..... 405/158; 405/224.4; 166/367

(58) Field of Classification Search ..... 405/158, 405/195.1, 224.5–224.4; 166/242.1–242.3, 166/367
See application file for complete search history.

(56) References Cited

U.S. PATENT DOCUMENTS

| | | | | |
|---|---|---|---|---|
| 4,367,055 | A | 1/1983 | Gentry et al. | 405/169 |
| 2003/0091396 | A1* | 5/2003 | Barras et al. | 405/158 |
| 2004/0218981 | A1* | 11/2004 | Chenin | 405/169 |
| 2005/0063788 | A1* | 3/2005 | Clausen | 405/224.2 |

* cited by examiner

*Primary Examiner*—Thomas B. Will
*Assistant Examiner*—Tara L Mayo
(74) *Attorney, Agent, or Firm*—Nixon & Vanderhye PC

(57) ABSTRACT

A compensating suspension element that includes a flexible cable, a flexible pipe and a catenary riser pipe and a connecting device connecting the flexible cable, the flexible pipe and the riser without buoyancy.

4 Claims, 1 Drawing Sheet

COMPENSATING SUSPENSION ELEMENT CONFIGURATION

This application is based on, claims the benefit of priority of, and incorporates hereby by reference the contents of Brazilian Patent Application No. PI 0400422-1 filed on Mar. 2, 2004.

SCOPE OF THE INVENTION

The present invention refers to a compensating suspension element configuration, which tends to minimize undesirable movements at the top of suspended pipes in floating structures and to facilitate the arrangement of incoming pipes and the correct operation to install and connect these. More particularly, this design is applicable for use in deep and ultra-deep water operation and prioritizes the operational performance of flexible pipes (risers) and other pipes that arrive at the floating structure.

FUNDAMENTALS OF THE INVENTION

During the last years, significant technological innovations in anchoring systems have been developed, as well as in flexible pipes (risers) for intake and output of floating structure products.

However, a major problem is still encountered by technical specialists in the sector, which is floating structure movement during operation, caused by the action of external factors, as for example, the action of ocean waves. This movement is transmitted directly to the riser pipes, triggering problems with higher tension or even fatigue. Projects specifically developed for operational requirements of risers have become more and more expensive and consequently more difficult to use.

Economic viability of current deep water production locations is dependent on a reduction in total installation and operational cost in floating structures.

One way to minimize the problem that exists when carrying out projects using riser pipes is to use floating structures with little ocean wave induced movement, in other words, hulls displaying little sensitivity to the agitation produced by ocean waves. Such hulls may be much more expensive than a conventional ship hull, making it economically impractical for certain enterprises.

A second attempt to minimize the negative effects that floating structure movement on flexible riser pipes have on developing projects, is to adopt a configuration using buoys at intermediate points along the flexible riser pipes. The buoy divides the catenary curve formed by the flexible riser pipes in such a way as to isolate the lower end of the riser that touches the ground at the bottom of the ocean from the movements to which the floating structures are submitted, caused by external forces and more specifically, by the action of ocean waves.

An example of this second alternative is described in the Patent Document, U.S. Pat. No. 4,367,055. In this document describes the use of buoys that are submerged separately along the riser pipes below the aquatic turbulence zone, in such a way that they receive many conduits, which are located at the intervals where the buoys are placed.

However, this option presents the inconvenience of high cost, besides the fact that the operational system, for which the use of submerged giant buoys is necessary, is difficult to install and maintenance is difficult to perform, when necessary. This is because is always difficult and costly to perform maintenance in submerged systems, especially when it requires saturation diving.

The new deep water Stationary Production Unit (UEP) project must focus on the production and output risers project and, whenever possible, make use of Steel Catenary Risers (SCR—Steel Catenary Risers). SCRs are susceptible to floating structure movement, even though their construction cost is lower, a fact which makes using the present invention advantageous. In the case of flexible risers, using this invention's device is important because it isolates the movements of the floating structure and does so without imposing any severe conditions due to its size.

In current settings, the use of SCR (Steel Catenary Riser) directly connected to FPSO's (Floating Production, Storage and Offloading) is still impractical due to movement of the FPSO.

The alternative of building new low movement hulls such as, for example, TLP, SPAR or MONOCOLUNA, may be attractive as a low cost solution for some situations, due to the high cost of building these types of floating structures.

This invention seeks to solve the problems and disadvantages of the state of the art, previously presented.

SUMMARY OF THE INVENTION

The present invention presents a compensating suspension element configuration, geared to minimize undesirable movement on the top of suspended pipes in floating structures.

The compensating suspension element configuration, as presented in the invention, is composed of a mooring cable assembly, or a combination of these, manufactured of synthetic material or steel, where said cable possesses a special structural design in order to have low rigidity and high load capacity in order to make the flexible riser pipe system less sensitive to the movements of the floating structure, minimizing stress along the riser system.

The purpose of said compensating suspension element is to filter the movements that touch the head of the riser. This characteristic of the compensating suspension element allows a greater flexibility in the choice of intake and output conduits in a floating production unit.

DETAILED DESCRIPTION OF THE INVENTION

Figure 1:
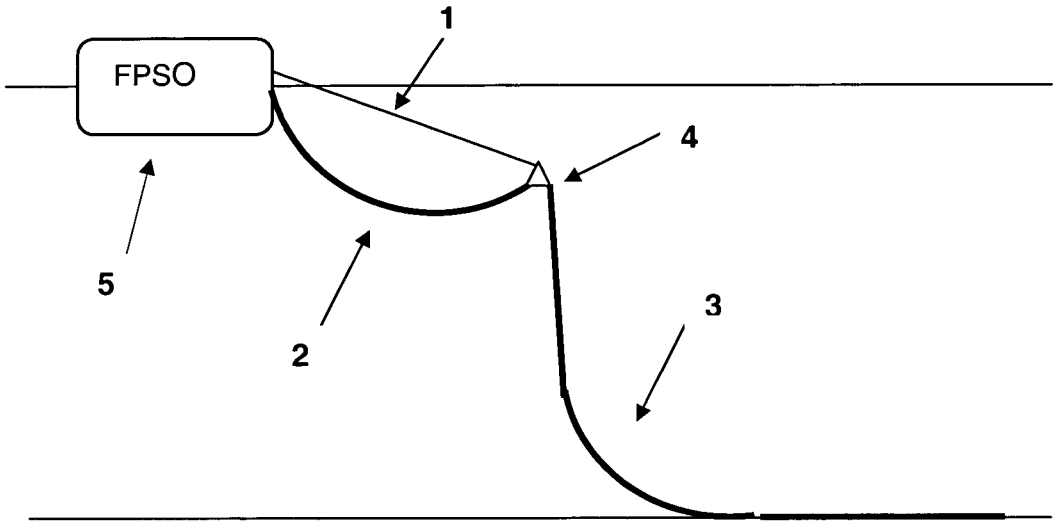
FIG. 1 shows the compensating suspension element configuration, in accordance with the present invention.

The compensating suspension element configuration of the present invention is illustrated and diagramed in FIG. 1 that forms part of the present report.

In FIG. 1 a schematic illustration of the system and the parts that make up the compensating suspension element configuration may be seen. The compensating suspension element configuration of the present invention is shown in FIG. 1. It is in a Y configuration. The compensating suspension element configuration consists of a compensating cable or sustaining cable, or any configuration made up of a mooring cable, cable and pipeline accessories, that dispenses with the use of a flexible joint (flexpoint) and releases the configuration at any angle in which a floating production unit pipe enters, as for example, in the FPSO's.

The compensating suspension element includes:

a flexible cable (1), which gives the quality of sustaining to the compensating suspension element, and suspended, forms the first upper leg of the compensating suspension element.

a flexible pipe (2), preferably a "Jumper", which suspended, forms the second upper leg of the compensating suspension element, which will be used to transfer liquids to the ship, or vice versa.

a Catenary Riser pipe (3). This may be a flexible or Steel Catenary Riser.

a connecting device (4) located in a position so as to connect the flexible cable (1), the flexible pipe (2) and the riser (3) of the compensating suspension element, where said connecting device (4) imparts stability to the compensating suspension element so that the flexible cable connection (1) may remain rigid where it connects to the floating structure (5), represented by a FPSO type unit;

The connecting device (4) can be, for example, a pipe type of device with or without a piggable bend.

In this prototype, the compensating suspension element will anchor the catenary riser (3) to floating structure (5) and the elasticity given to the compensating suspension element will be responsible for reducing the transmission of movement from the floating structure (5) to the catenary riser (3). This elastic characteristic of the compensating suspension element is attributable to the flexible cable (1) that links the head of riser (3) with the so-called pipe (4), to the floating structure (5). As illustrated, no tethers or anchors extending from the catenary riser to the seabed are required.

The assembly of the compensating suspension element and the procedure for its installation in the floating structure (5), are easily and securely performed. The flexible pipeline (2) connects the connecting element (4) (for example a pipe) to the floating structure (5), so that the transference of product from the well to the floating structure (5) is performed. The flexible pipeline (2) (the so-called "Jumper"), absorbs the movements caused by the floating structure (5) without suffering structural damage.

Despite the invention's use of a FPSO type floating structure as an example, the compensating suspension element configuration is applicable to any permanent production structure, even those that have low movement, because the lower the amount of movement caused by the permanent production structure, the less rigid the mechanical specifications of the flexible cable (1) need to be.

The length of the flexible cable (1), in addition to the point where the connecting device is located (4), is variable. Said length and said location of the connecting device (4), are determined depending on the rigidity desired for the compensating suspension element configuration.

The flexible cable (1) may be made up of steel cable, synthetic cable or a mooring cable set, or even a combination of these, in order to give the flexibility necessary to compensate for the movement of the platform and to prevent transferring these movements to the catenary riser.

It should be mentioned that to connect the compensating flexible cable (1) and the "Jumper" (2) to the hull of floating structure (5), only load anchor rings should be used, thus dispensing with the need to use complex connectors such as riser heads (3) with flexible joints.

Despite the invention having been described in detail and with reference to its specific prototypes, it must be remembered that specialists in the field may make some alterations and modifications in keeping with the spirit and scope of the invention.

The invention claimed is:

1. A compensating suspension element configuration, which tends to minimize undesirable movements at the top of suspended pipes of a floating production, storage and offloading structure and to facilitate the arrangement of incoming pipes and the correct operation to install and connect these, characterized by the following:

a flexible cable extending from said floating structure, said flexible cable, suspended, forms the first upper leg of the compensating suspension element;

a flexible pipe extending from said floating structure, which suspended, forms the second upper leg of the compensating suspension element;

a Catenary Riser pipe; and a connecting device located in a position so as to connect the flexible cable, the flexible pipe and the riser of the compensating suspension element, said riser extending from said connecting device through a single catenary curve to seafloor, wherein said connecting device imparts stability to the compensating suspension element, the connecting device consisting of a pipe having a bend therein for connecting said flexible pipe and catenary riser pipe at an angle and a connector for said flexible cable, without buoyancy, to maintain a rigid connection between said flexible cable and the floating structure.

2. The compensating suspension element configuration, in accordance with claim 1, characterized by said flexible cable being selected from the group consisting of a synthetic cable, a steel cable, a set of mooring cables, or a combination of synthetic and steel cables.

3. The compensating suspension element configuration, in accordance with claim 1, characterized by a Y format.

4. The compensating suspension element configuration, in accordance with claim 1, characterized by said catenary riser comprising either a flexible or a steel catenary riser.

* * * * *